US010371082B1

(12) United States Patent
Dikeman et al.

(10) Patent No.: US 10,371,082 B1
(45) Date of Patent: Aug. 6, 2019

(54) FUEL INJECTOR CONTROL INCLUDING STATE SELECTION BASED ON A CONTROL SIGNAL CHARACTERISTIC

(71) Applicant: DELPHI TECHNOLOGIES IP LIMITED, St. Michael (BB)

(72) Inventors: John Mark Dikeman, Burnside, KY (US); Mark W. Gose, Kokomo, IN (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 15/876,659

(22) Filed: Jan. 22, 2018

(51) Int. Cl.
*F02D 41/30* (2006.01)
*F02M 51/06* (2006.01)

(52) U.S. Cl.
CPC ..... *F02D 41/3005* (2013.01); *F02M 51/06* (2013.01)

(58) Field of Classification Search
CPC ..... F02M 51/06; F02M 69/145; F02D 41/40; F02D 41/402; F02D 41/2467; F02D 41/247; F02D 41/20; F02D 2041/2003; F02D 2041/2006; F02D 2041/2017; F02D 2041/202; F02D 2041/2034; F02D 2041/2037
USPC ..... 123/472, 478, 480, 482, 486, 490
See application file for complete search history.

(56) References Cited

U.S. PATENT DOCUMENTS 4,064,423 A 12/1977 Atkisson, Jr.
5,430,601 A 7/1995 Burcham
5,592,921 A 1/1997 Rehbichler
5,701,870 A 12/1997 Gottshall et al.
7,415,964 B2 * 8/2008 Ban ..... F02D 41/20 123/299
7,945,372 B2 * 5/2011 Geveci ..... F02D 41/0087 701/103
8,581,765 B2 11/2013 Marshall, Jr. et al.
8,736,477 B2 5/2014 Marshall, Jr. et al.
9,188,074 B2 11/2015 Cheever, Jr. et al.
10,221,800 B1 * 3/2019 Gose ..... F02D 41/266
2005/0199221 A1 9/2005 Dietl et al.
2009/0217914 A1 9/2009 Casasso
2009/0287393 A1 11/2009 Moller et al.
2012/0055449 A1 3/2012 Lucano et al.
2014/0043000 A1 2/2014 Bojarski et al.
(Continued)

FOREIGN PATENT DOCUMENTS

DE 102007042995 A1 3/2009
EP 854281 A2 7/1998
EP 1426597 A1 6/2004
(Continued)

*Primary Examiner* — Hai H Huynh
(74) *Attorney, Agent, or Firm* — Joshua M. Haines

(57) ABSTRACT

An illustrative embodiment of a fuel injector control system includes a driver that is configured to supply electrical power to a fuel injector. A controller is configured to control the driver by implementing a predetermined sequence of a plurality of states for an injection cycle. The plurality of states each include parameters for supplying electrical power to the fuel injector. The controller selects one of the states to implement as a next one of the states in the sequence based on a characteristic of an activation signal and information indicative of the state corresponding to the characteristic of the activation signal.

20 Claims, 5 Drawing Sheets

(56) References Cited

U.S. PATENT DOCUMENTS

2016/0237937 A1* 8/2016 Kusakabe ..... F02D 41/20

FOREIGN PATENT DOCUMENTS

| | | | |
|---|---|---|---|
| EP | 2484885 | A1 | 8/2012 |
| WO | 2016198184 | A1 | 12/2016 |

* cited by examiner

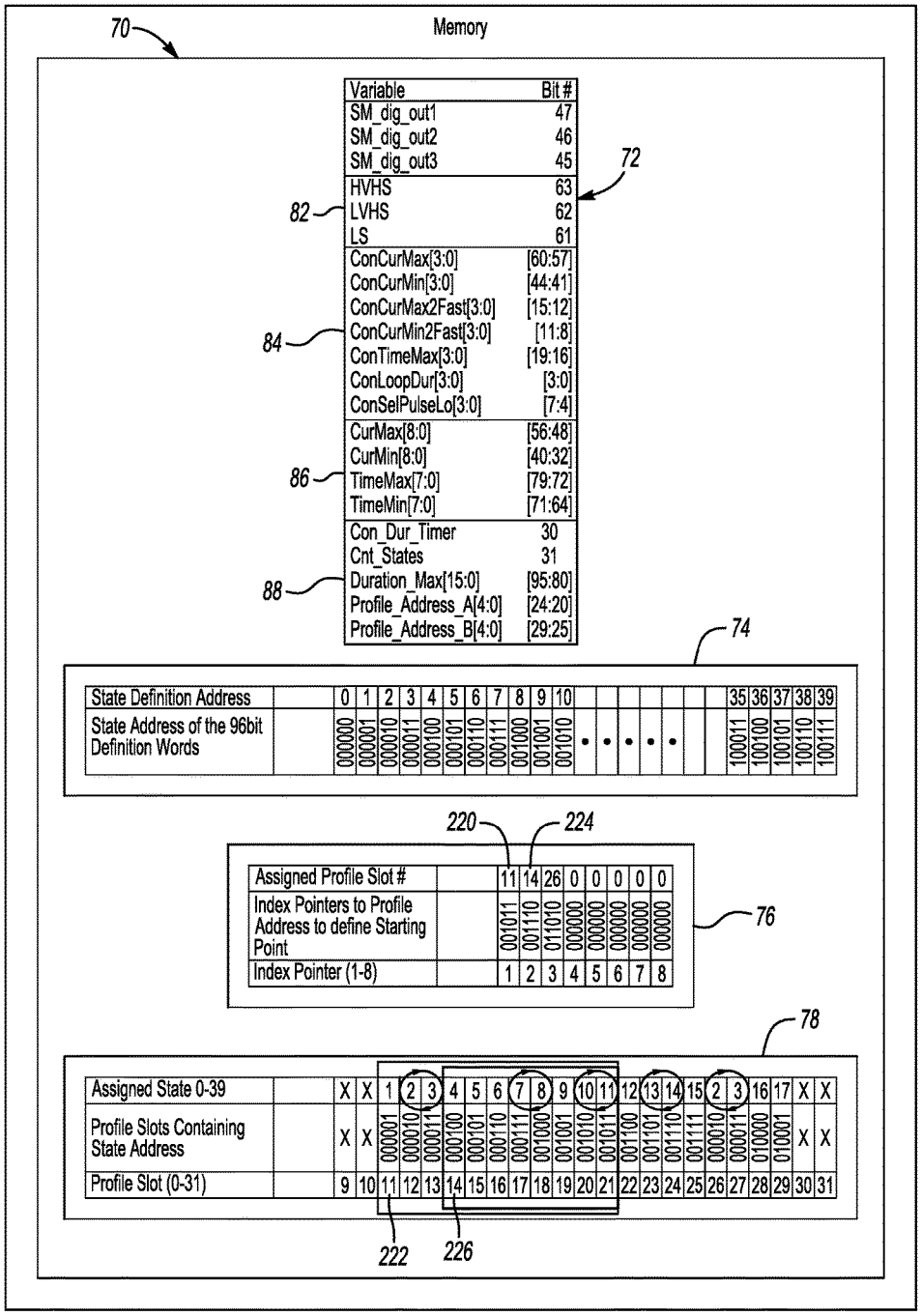

| Variable | Bit # |
|---|---|
| SM_dig_out1 | 47 |
| SM_dig_out2 | 46 |
| SM_dig_out3 | 45 |
| HVHS | 63 |
| LVHS | 62 |
| LS | 61 |
| ConCurMax[3:0] | [60:57] |
| ConCurMin[3:0] | [44:41] |
| ConCurMax2Fast[3:0] | [15:12] |
| ConCurMin2Fast[3:0] | [11:8] |
| ConTimeMax[3:0] | [19:16] |
| ConLoopDur[3:0] | [3:0] |
| ConSelPulseLo[3:0] | [7:4] |
| CurMax[8:0] | [56:48] |
| CurMin[8:0] | [40:32] |
| TimeMax[7:0] | [79:72] |
| TimeMin[7:0] | [71:64] |
| Con_Dur_Timer | 30 |
| Cnt_States | 31 |
| Duration_Max[15:0] | [95:80] |
| Profile_Address_A[4:0] | [24:20] |
| Profile_Address_B[4:0] | [29:25] |

| State Definition Address | | 0 | 1 | 2 | 3 | 4 | 5 | 6 | 7 | 8 | 9 | 10 | | | | | | | | 35 | 36 | 37 | 38 | 39 |
|---|---|---|---|---|---|---|---|---|---|---|---|---|---|---|---|---|---|---|---|---|---|---|---|---|
| State Address of the 96bit Definition Words | | 000000 | 000001 | 000010 | 000011 | 000100 | 000101 | 000110 | 000111 | 001000 | 001001 | 001010 | • | • | • | • | • | | | 100011 | 100100 | 100101 | 100110 | 100111 |

| Assigned Profile Slot # | | 11 | 14 | 26 | 0 | 0 | 0 | 0 | 0 |
|---|---|---|---|---|---|---|---|---|---|
| Index Pointers to Profile Address to define Starting Point | | 001011 | 001110 | 011010 | 000000 | 000000 | 000000 | 000000 | 000000 |
| Index Pointer (1-8) | | 1 | 2 | 3 | 4 | 5 | 6 | 7 | 8 |

| Assigned State 0-39 | | X | X | 1 | 2 | 3 | 4 | 5 | 6 | 7 | 8 | 9 | 10 | 11 | 12 | 13 | 14 | 15 | 2 | 3 | 16 | 17 | X | X |
|---|---|---|---|---|---|---|---|---|---|---|---|---|---|---|---|---|---|---|---|---|---|---|---|---|
| Profile Slots Containing State Address | | X | X | 000001 | 000010 | 000011 | 000100 | 000101 | 000110 | 000111 | 001000 | 001001 | 001010 | 001011 | 001100 | 001101 | 001110 | 001111 | 000010 | 000011 | 010000 | 010001 | X | X |
| Profile Slot (0-31) | | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 |

Fig-2

FUEL INJECTOR CONTROL INCLUDING STATE SELECTION BASED ON A CONTROL SIGNAL CHARACTERISTIC

BACKGROUND

Fuel injectors have proven useful for delivering fuel to an engine to achieve desired performance. Fuel injection control has become increasingly sophisticated to meet more stringent fuel economy and vehicle emission requirements. Additionally, vehicle and engine manufacturers expect improved diagnostic capabilities compared to existing systems. Typical fuel injector control arrangements require additional microprocessor intervention and supplemental discrete circuit implementations to attempt to address such needs. The typical phase-based control is limited in the way in which current can be supplied to fuel injectors. The many variations among fuel injector systems that exist for different engine types makes these difficulties in fuel injector control even more challenging to overcome in an efficient manner.

SUMMARY

An illustrative embodiment of a fuel injector control system includes a driver that is configured to supply electrical power to a fuel injector. A controller is configured to control the driver by implementing a predetermined sequence of a plurality of states for an injection cycle. The plurality of states each include parameters for supplying electrical power to the fuel injector. The controller selects one of the states to implement as a next one of the states in the sequence based on a characteristic of an activation signal and information indicative of the state corresponding to the characteristic of the activation signal.

An illustrative example method of controlling a fuel injector is based on a plurality of predefined states that each include parameters for supplying electrical power to a fuel injector. The method includes controlling power supplied to a fuel injector according to a predetermined sequence of the states for an injection cycle, and selecting one of the states to implement as a next one of the states in the sequence based on a characteristic of an activation signal and information indicative of the state corresponding to the characteristic of the activation signal.

Various features and advantages of at least one disclosed example embodiment will become apparent to those skilled in the art from the following detailed description. The drawings that accompany the detailed description can be briefly described as follows.

BRIEF DESCRIPTION OF THE DRAWINGS

FIG. 2 schematically represents database contents defining a plurality of states and an example sequence of such states useful for controlling a fuel injector according to an embodiment of this invention.

DETAILED DESCRIPTION

Embodiments of this invention provide adaptive control over the power supply to a fuel injector during a fuel injection cycle to respond to various conditions that affect engine performance or fuel injector operation. A plurality of test parameters, which may be related to current and time, associated with each of a plurality of states establish fuel injector control that satisfies defined relationships between current and time, for example, and allow for adjusting the injector control waveform and providing diagnostic capability.

Figure 1:
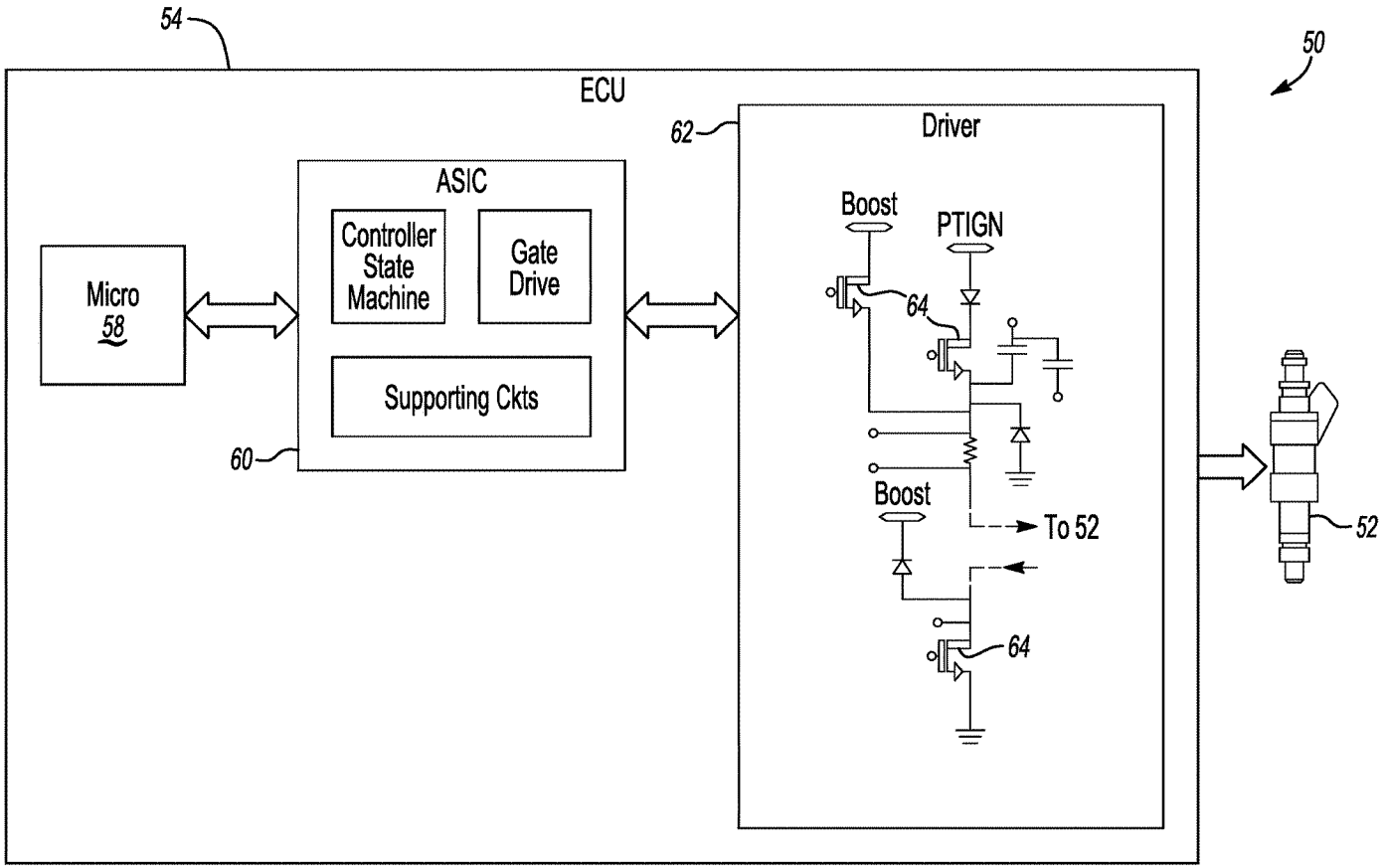
FIG. 1 schematically illustrates a fuel injector control system designed according to an embodiment of this invention.

FIG. 1 schematically illustrates a fuel injector control system 50 for controlling the operation of a plurality of fuel injectors that deliver fuel to a vehicle engine (not illustrated). A single fuel injector 52 is illustrated for discussion purposes. The control system 50 includes a controller 54. In some embodiments the controller 54 is part of an engine control unit (ECU) while in others the components that perform the functions of the controller 54 in this description are distinct from the ECU. Those skilled in the art who have the benefit of this description will be able to select an appropriate arrangement of control hardware, circuitry, software, or firmware to meet the needs of their particular implementation.

In the illustrated example, the controller 54 includes a microprocessor 58 and an application specific integrated circuit (ASIC) 60. The microprocessor 58 performs various functions including monitoring engine operating conditions such as the engine RPM, fuel pressure, temperature and other factors that those skilled in the art already understand. The ASIC 60 controls a driver 62 for supplying power to the fuel injector 52 during an injection cycle or spark cycle. The driver 62 includes a plurality of field effect transistors (FET) 64 that are selectively switched to deliver current to the fuel injector 52.

The control system 50 operates based on a plurality of states that define or establish how power is supplied to the fuel injector 52. U.S. Pat. No. 9,188,074 describes generating a drive signal for operating a fuel injector based on a desired pulse profile that is established by a sequence of states. The entire disclosure of U.S. Pat. No. 9,188,074 is incorporated by reference into this specification. The states used in the disclosed example embodiment are designed according to the teachings of that patent.

The control system 50 includes the ability to adaptively modify or change the way in which the fuel injector 52 receives power based upon various conditions during an injection cycle. In addition to using the state-based approach described in U.S. Pat. No. 9,188,074, the system 50 utilizes a plurality of test parameters that establish or define desired or acceptable operating characteristics during an injection cycle. Each of the states in a sequence of states used for controlling power supply to the fuel injector has its own set of test parameters so that the control system 50 may adapt the way in which power is supplied to the fuel injector 52 during any of those states and in a manner that may be customized for each state. Additionally, the test parameters provide diagnostic information depending on which of the parameters is met.

A memory includes the plurality of states and information regarding at least one sequence of those states useful for fuel injection control. The memory also includes information regarding the plurality of test parameters for each of the states. The memory is associated with or included as part of the controller 54, the microprocessor 58, the ASIC 60, or distributed among them.

FIG. 2 schematically illustrates a database 70 within the memory. The database 70 includes a state definition library 72 that establishes the conditions and parameters for each of a plurality of states. In an example embodiment, there are forty unique states and the state definition library schematically shown at 72 comprises a 40×96 bit data array. Another portion of the database 70 provides state definition address information schematically shown at 74. Another portion of the database 70 schematically shown at 76 is an index register that facilitates the ASIC 60 moving to an appropriate one of the states at an appropriate time to accomplish a desired signal profile for powering a fuel injector. The database 70 also includes a sequence or profile register 78 that establishes a sequence of states to be used during an injection cycle.

The example state definition library 72 includes information shown at 82 that identifies the FETs 64 of the driver 62 that will be controlled to establish the desired current waveform. A plurality of test parameters are defined at 84. Threshold values for current and time are defined at 86. Information stored at 88 establishes timer values, a counter value and information for proceeding through a profile or sequence of the states.

Figure 3:
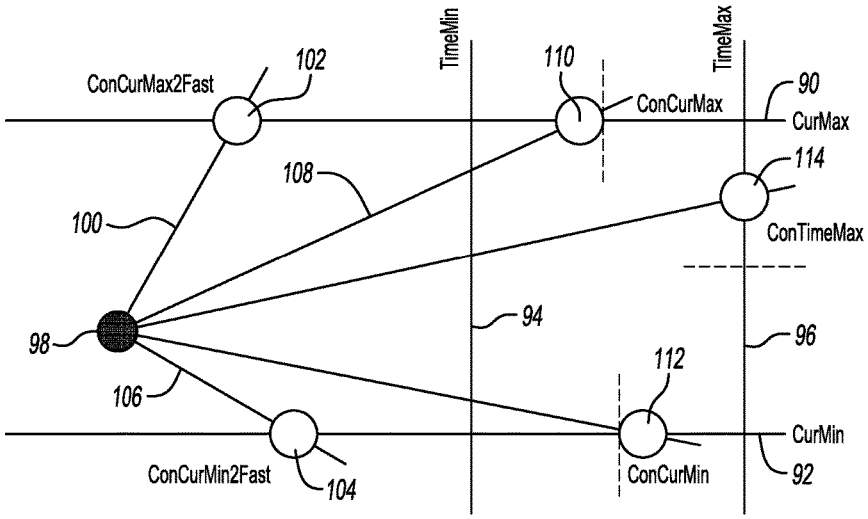
FIG. 3 schematically illustrates a plurality of test parameters useful for adaptively controlling a fuel injector according to an embodiment of this invention.

FIG. 3 schematically illustrates how the test parameters defined at 84 and the thresholds or boundaries defined at 86 are useful during an injection cycle for adaptively controlling current supply to a fuel injector 52. A maximum current threshold (CurMax) 90 defines a maximum desired or allowable current for the corresponding state. Each state will have its own maximum current threshold 90. A minimum current threshold (CurMin) is shown at 92. Each state will have its own minimum threshold 92.

The illustrated embodiment includes adaptive fuel injector control based on a relationship between current and time. Two time thresholds are included in the example of FIG. 3 to establish a window of time within which a target current value should be achieved during a corresponding state. A minimum time threshold 94 (TimeMin) and a maximum time limit 96 (TimeMax) establish the time window boundaries in this example. The particular values for CurMax, CurMin, TimeMin, and TimeMax are defined for each state at 86 in the state definition library 72.

FIG. 3 schematically represents test parameters defined at 84 in FIG. 2 in relation to a present or initial current value schematically represented at 98. If the current for operating the fuel injector 52 changes at a rate represented at 100, the current value will reach the maximum current threshold 90 at 102. If that condition occurs, the conditional test parameter for reaching the maximum current value too quickly is met. In other words, one of the plurality of test parameters defined at 84 and labeled ConCurMax2Fast is met because the current reached the threshold 90 prior to the minimum required amount of time 94 passing. This condition may exist, for example, when there is an electrical short in the driver 62.

Another of the test parameters is represented at 104 corresponding to the current reaching the minimum current threshold 92 prior to the expiration of the minimum amount of time defined at 94. For example, if the current changes at a rate schematically represented at 106, the test parameter ConCurMin2Fast will be met. The information in the state definition library 72 stored at 84 regarding the test parameter ConCurMin2Fast defines or establishes how the ASIC 60 responds to that test parameter being met.

Under conditions where the current changes from the value schematically shown at 98 at the rate schematically shown at 108, the maximum current value 90 is reached at 110. Under these conditions, the test parameter ConCurMax is met or satisfied. This test parameter indicates to the ASIC 60 that the objective of reaching the current value schematically shown at 90 has been met for this state because that current value was achieved at a time between the time thresholds 94 and 96 that establish the desired timing window for reaching that current value during that state.

When a state includes decreasing the current from the value schematically shown at 98 to a value shown at 112, for example, a test parameter ConCurMin is met. Under this condition, the ASIC 60 determines that an appropriate rate of current decrease or discharge has occurred for the corresponding state.

Some states will include a desired time or duration and the test parameter ConTimeMax will be met when the current stays between the current thresholds 90 and 92 for a period corresponding to the maximum time threshold shown at 96. In FIG. 3 the current has a value as schematically shown at 114 when this test parameter is met.

As can be appreciated from FIG. 3, when a state involves a change in current over time, the desired operation will be achieved for that state when the resulting current is within the set of values defined at 86 (FIG. 2) schematically represented by the area in FIG. 3 outlined by the values shown at 90, 92, 94 and 96. Any of the test parameters used for establishing the target values or value of current with respect to time are considered target parameters because they establish the target or desired performance during the corresponding state of an injection cycle. At least one of the test parameters may be a primary target for a given state that create or define the desired current waveform. In many instances each state has multiple primary target test parameters. Others of the test parameters serve as secondary target parameters that correspond to unintended conditions deviating from the desired current waveform and such test parameters are considered diagnostics that provide diagnostic information regarding injector operation when any of the diagnostic parameters is met. For example, the ASIC 60 will report the profile position, the profile slot number and the test parameter that was met for further diagnostic analysis. Some test parameters that are outside of the target range or ranges are considered fault indicator parameters because they indicate to the ASIC 60 that performance is outside of the expected or desired range for that state. Depending on the particular parameter that is satisfied and the characteristics of the corresponding state, the ASIC 60 may report a fault or other information useful for diagnostics or analysis in addition to altering the manner in which power is supplied to the fuel injector.

There are seven test parameters represented at 84 with five of those being schematically represented in FIG. 3. The other two test parameters in this example include one referred to as ConSelPulseLo, which is used with an interrupt signal sent from the microprocessor 58 to the ASIC 60 to interrupt a state to adjust the current waveform. Instead of continuing through the sequence of states for a particular injection cycle, the ASIC 60 responds to an interrupt signal when the condition for the ConSelPulseLo test parameter is met in a way that alters the current waveform during a subsequent portion of the injection cycle.

Another test parameter in the example of FIG. 2 is labeled ConLoopDur and is useful for establishing a loop in which at least two of the states are cyclically repeated for a desired amount of time described by ConLoopDur.

The illustrated example embodiment includes treating the seven example test parameters in a hierarchical fashion with one of the test parameters having a higher priority than at least one other test parameter. In this example, the ConSelPulseLo test parameter has highest priority such that whenever that test is met the ASIC 60 responds accordingly regardless of the status of all other test parameters. The other parameters in the illustrated example are ranked in the following order from highest priority to lowest: ConCurMax2Fast, ConCurMin2Fast, ConLoopDur, ConCurMax, ConCurMin, and ConTimeMax.

The memory includes information in the state definition library at 84 that establishes whether the test parameter is a target parameter or a fault indicator parameter. Additionally, the information at 84 instructs the ASIC 60 how to control the driver 62 for a subsequent portion of an injection cycle when the test parameter is met.

Figure 4:
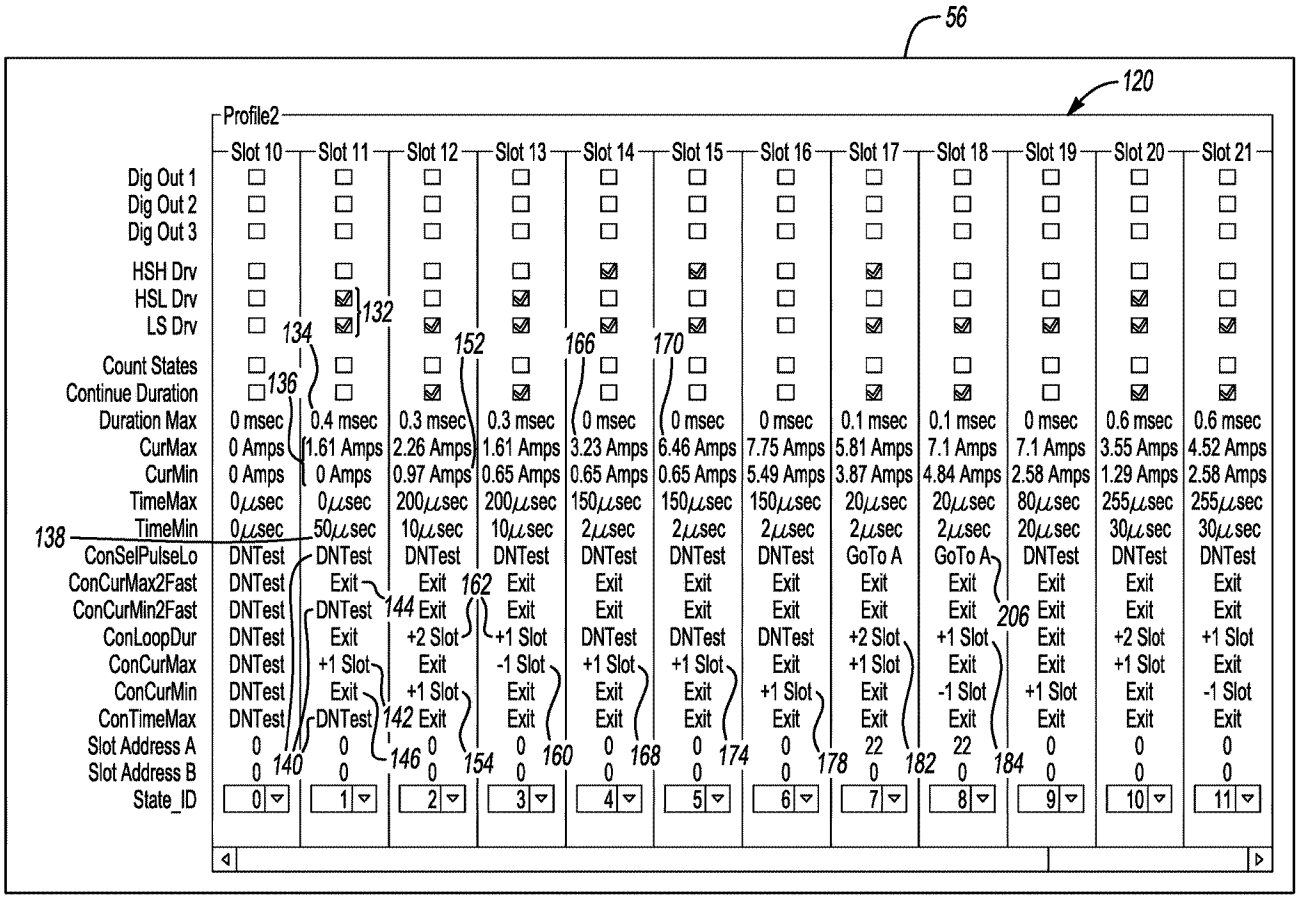
FIG. 4 schematically illustrates example database contents setting a plurality of test parameters for a sequence of states used for controlling a fuel injector according to an embodiment of this invention.

FIG. 4 schematically illustrates information within the memory for a predefined sequence of states 120 that establishes the profile of a current waveform used for powering a fuel injector 52 during an injection cycle. The columns in FIG. 4 each contain information corresponding to a respective state definition from the library 72 (FIG. 2) for twelve different states.

Figure 5:
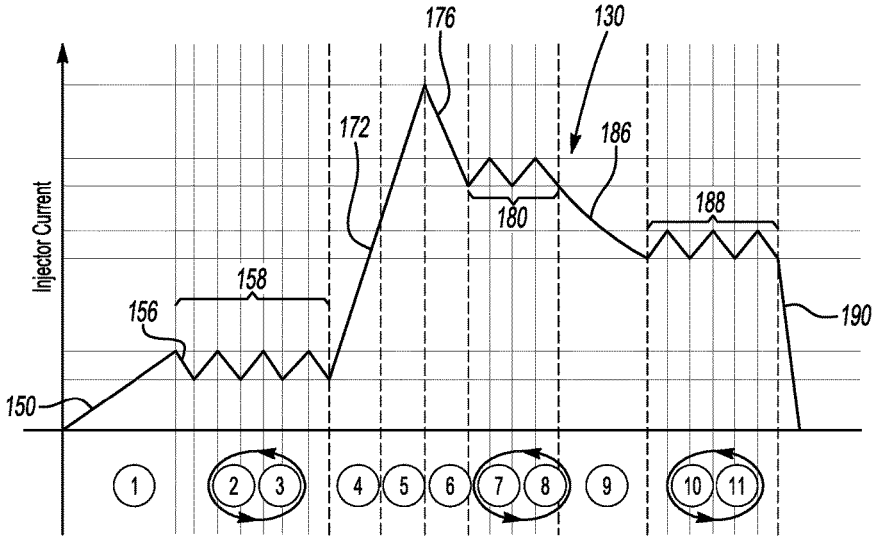
FIG. 5 graphically illustrates an example current waveform resulting from an example fuel injector control technique designed according to an embodiment of this invention.

As the ASIC 60 controls the driver 62 according to the sequence of states represented at 120, the resulting current waveform will be as shown at 130 in FIG. 5. The ASIC 60 receives an appropriate start signal from the microprocessor 58 and begins control over the driver 62 to provide power to the fuel injector 52 using the state 1 in slot 11 of the profile defining the sequence of states 120. The information within the state definition library 72 for state 1 includes an indication that two of the FETs 64 will be turned on, which is shown at 132 in FIG. 4. As shown at 134, the maximum duration for state 1 is 0.4 msec. The maximum current threshold (shown at 90 in FIG. 3) or the value for CurMax is set at 1.61 amps and the minimum current threshold (shown at 92 in FIG. 3) is set to 0 amps as shown at 136 in FIG. 4. In this example, state 1 includes an increase in current from an initial 0 value and the rate of current increase to the maximum value of 1.61 amps should be such that it takes at least 50 microseconds to reach that current value as shown at 138. The threshold shown at 94 in FIG. 3 corresponds to a time of 50 microseconds for state 1 of FIG. 4.

As shown at 140, several of the test parameters are not considered as having any importance while the ASIC 60 is performing state 1. Those test parameters include an indication not to be tested (DNTest).

The test parameter ConCurMax is the primary target test parameter for state 1 and when the target current corresponding to the maximum current threshold (e.g., 1.61 amps in this example) is achieved in an appropriate amount of time, the test parameter ConCurMax is met and the ASIC 60 determines how to control the driver 62 for a subsequent portion of the injection cycle based on that test parameter being met. In FIG. 4, an indication at 142 indicates how the ASIC 60 continues through the sequence 120. In this particular example, the ASIC 60 will move forward one slot in the sequence as shown at 142. When the ASIC 60 moves forward one slot, it implements state 2.

Two of the test parameters for state 1 are considered diagnostic parameters in this example. ConCurMax2fast and ConCurMin indicate a condition that requires reporting information or an indication which may be used for maintenance or diagnostic purposes, for example. In the illustrated example, if the rate of current change is too fast and the ConCurMax2Fast condition is met, the ASIC 60 will exit state 1 as shown at 144 and will discontinue the sequence 120. At this point, the ASIC 60 will wait for a next start or initiation signal from the microprocessor 58 to begin a next injection cycle. Similarly, if the ConCurMin test parameter is met, as shown at 146, the ASIC 60 is instructed to exit the sequence 120, which would terminate the injection cycle.

If the injector control follows the desired parameters established for state 1, a resulting current increase as shown at 150 in FIG. 5 is the first portion of a current waveform profile for the injection cycle. When the target parameter is met, the ASIC 60 advances to state 2 in slot 12 of the sequence 120. Assuming the target parameter corresponding to a minimum current value of 0.97 amps as shown at 152 is met, the ASIC 60 advances one slot as shown at 154 to initiate state 3 whose state definition is in slot 13 of the sequence 120 of FIG. 4. A corresponding portion of the current waveform profile is shown at 156 in FIG. 5.

One feature of the example profile 120 is that a current chop involving cycling back and forth in a loop between states 2 and 3 provides a current waveform profile as shown at 158 in FIG. 5. The conditional test parameters of states 2 and 3 establish the way in which the ASIC 60 performs the current chop control loop including the states 2 and 3. When the desired conditions of state 2 are met, the ASIC 60 advances one slot to state 3 as shown at 154 in FIG. 4. When the conditions for state 3 are satisfied, the ASIC 60 advances backward one slot to state 2 as shown at 160 in FIG. 4. The duration of the control loop used to establish the current chop at 158 is set by the test parameter ConLoopDur. As indicated at 162 in FIG. 4, the ASIC 60 will advance to a next state for achieving the desired current waveform profile by one slot if performing state 3 when ConLoopDur is met or by advancing two slots in the sequence 120 if performing state 2 when that test parameter is met. The instructions to the ASIC 60 for such an advance are shown at 162 in FIG. 4.

Assuming that none of the diagnostic test parameters were met while performing states 2 and 3, the ASIC 60 advances to slot 14 to perform state 4 as shown in FIG. 4. A target parameter CurMax of 3.23 amps is included in the state definition library for state 4 as shown at 166. When that current level is met, the ASIC 60 advances one slot as shown at 168 to perform state 5. The target test parameter CurMax for state 5 in this example has a maximum current value of 6.46 amps as shown at 170. Implementing states 4 and 5 results in a portion of the current waveform profile shown at 172 in FIG. 5. This example demonstrates how a current increase such as that shown at 172 may be divided among multiple states of a sequence to provide tighter control over the change in current over time. In this example, state 4 involves increasing the current approximately half way from the current value at the beginning of state 4 to the maximum peak value that is desired at the end of state 5.

Once the target value of 6.4 amps is reached in state 5, the ASIC 60 will advance one slot as shown at 174 in FIG. 4 to implement state 6. As shown by the current waveform profile at 176 in FIG. 5, state 6 is a discharging state during which the current for powering the fuel injector is decreased.

Once the target value of the target test parameter CurMin is met in state 6, the ASIC 60 will advance by one slot in the sequence 120 as shown at 178.

The next portion of the sequence 120 involves another current chop shown at 180 in FIG. 5 as the ASIC 60 loops between states 7 and 8. Once the corresponding target test parameter ConLoopDur is met, the ASIC 60 stops the current chop and advances in the sequence 120 by two slots as shown at 182 if state 7 is implemented when ConLoopDur is met. Otherwise, the ASIC 60 advances by one slot as shown at 184. The next portion of the current waveform profile shown at 186 is the result of implementing state 9. The last portion of the current waveform profile shown in FIG. 5 includes a current chop operation at 188 by implementing states 10 and 11 in a control loop manner similar to those described above. Once the corresponding target test parameter ConLoopDur, which sets a time limit on the current chop 188, is met, the ASIC 60 reaches the end of the sequence 120 and allows a discharge of the current at 190 in FIG. 5 and the ASIC 60 awaits a next injection cycle initiation signal from the microprocessor 58.

During any of the states of the sequence 120 when a diagnostic test parameter is met, the ASIC 60 will stop the current control and terminate the sequence in this example. Test parameters that have a corresponding entry "Exit" in the illustration of FIG. 4 in this example are considered diagnostics. Other sequences may include directions or instructions for a different adaptive response when a diagnostic test parameter is met.

The conditional test parameters included as part of the state definitions allow the ASIC 60 to adapt the performance of the sequence of states and, therefore, adapt the resulting current waveform profile in response to the conditions corresponding to the test parameters set for each state. Utilizing test parameters as part of discrete states allows for adaptive control in response to current conditions, for example, in a manner that reduces a processing load on the microprocessor 58 and the fuel injector control system 50. Additionally, the adaptive response for controlling a fuel injector 52 can be implemented in a wide variety of manners by defining the test parameters of different states accordingly and defining different sequences of states to achieve different current waveform profiles.

Figure 6:
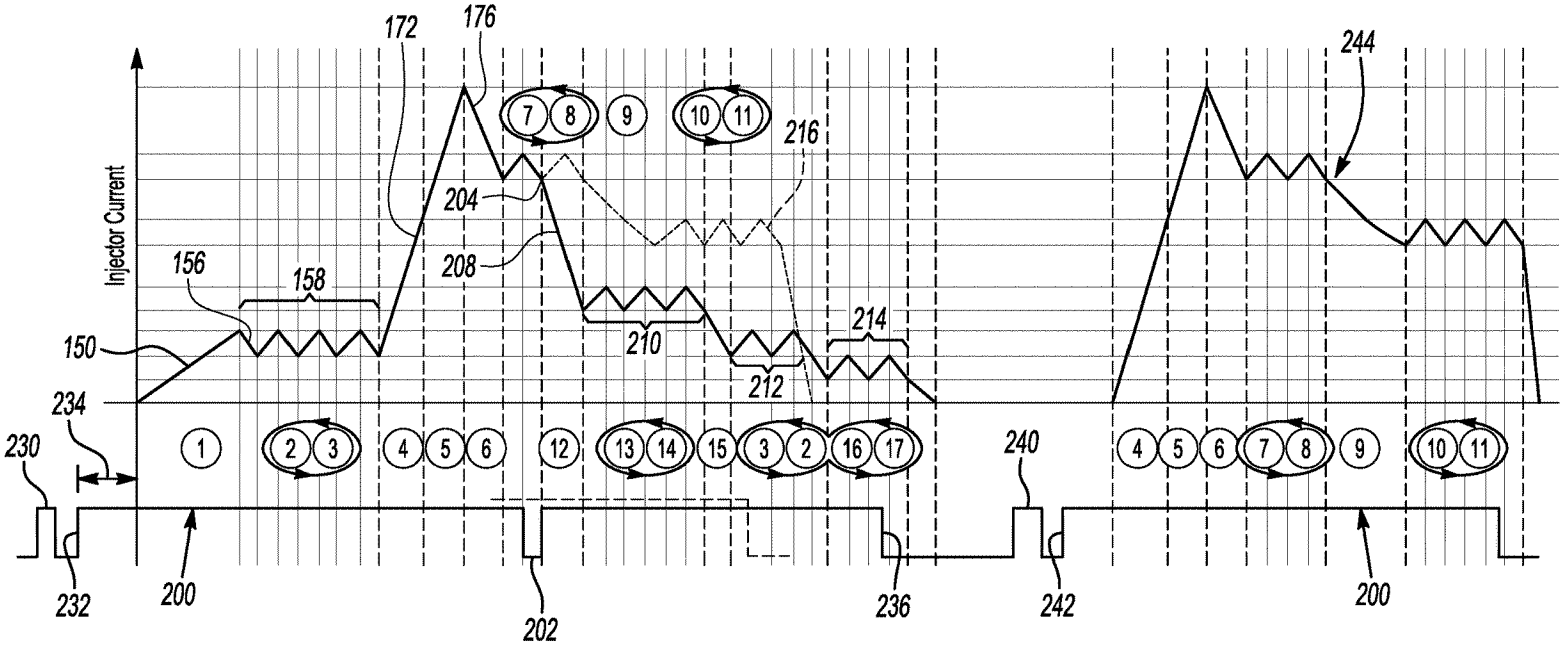
FIG. 6 graphically illustrates another example current waveform resulting from an example fuel injector control technique designed according to an embodiment of this invention.

FIG. 6 illustrates additional features that are included in the disclosed example embodiment. In this example, the microprocessor 58 utilizes signaling techniques to direct the ASIC 60 to achieve a desired current waveform profile and, under appropriate circumstances, to alter the current waveform profile during an injection cycle. For example, the microprocessor 58 monitors engine operating conditions and determines that the manner in which a fuel injector is being controlled according to a predetermined sequence of states for a given injection cycle should be altered. The microprocessor 58 has the ability to provide an interrupt signal to the ASIC 60 for reshaping or redirecting the current waveform profile under such circumstances.

FIG. 6 includes an activation signal 200 provided by the microprocessor 58 to the ASIC 60. When that signal is high in the illustrated example, the ASIC 60 implements a predefined sequence of states like that shown in FIG. 4, for example. Assuming the microprocessor 58 determines that interrupting the selected sequence is necessary for redirecting the current waveform profile, the microprocessor 58 provides an interrupt signal in the form of a pulse 202, which is interpreted by the ASIC 60 as the ConSelPulseLo test parameter being met. In the illustrated example, the interrupt signal comprises a low pulse that lasts for one microsecond. At the end of that pulse as shown at 204 in FIG. 6, in response to the interrupt signal pulse 202, the ASIC 60 interrupts the current chop otherwise implemented by the control loop including states 7 and 8.

In the example of FIG. 6, the ASIC 60 was implementing state 8 when the ASIC 60 detected the interrupt signal 202 and, according to FIG. 4, the ASIC 60 follows an instruction at 206. In this example, that instruction corresponds to moving to slot number 22 and performing the state assigned to that slot. As shown in the profile register 78 of FIG. 2, slot 22 corresponds to state 12. The state definition of state 12, when implemented by the ASIC 60 results in a decrease in the current as shown at 208 in FIG. 6. Once the target minimum current value for state 12 is met, the ASIC 60 proceeds to a control loop including states 13 and 14 resulting in a current chop as shown at 210. The rest of the sequence of states shown in the profile index at 78 of FIG. 2 includes state 15 followed by a control loop involving states 2 and 3 and another control loop involving states 16 and 17 resulting in the current chops shown at 212 and 214, respectively.

In the example of FIG. 6, the current decrease at 208-214 corresponds to a discharge. Such a discharge may be a pulldown to ground or battery. Some inductive loads are very sensitive to battery level, resulting in di/dt variations. For example, a discharge current may at least temporarily increase instead of decreasing (e.g., pulldown to Battery instead of ground). Using six different states at 208, 210, 212 and 214 instead of just two states, for example, provides an adaptive chop to compensate for such variations in current. In the example of FIG. 6, the ConCurMin2Fast test parameter is used to determine the di/dt rate of change and adapt by stepping into the proper state. In FIG. 6, a group of six states are used in alternating fashion to complete the chop.

The interrupt signal 202 instructed the ASIC 60 to alter the control of the fuel injector 52 for the portion of the injection cycle following the control pulse from a current waveform profile shown in broken lines at 216 to that shown at 208, 210, 212 and 214. The interrupt signal 202 provided by the microprocessor 58 allows for adaptive control over the current waveform used for supplying power to a fuel injector during an injection cycle based on conditions that the microprocessor 58 is responsible for monitoring and that are outside of the purview of the ASIC 60. This approach takes advantage of the adaptive, responsive control provided by including conditional test parameters within the definition of the individual states.

Another control feature of the illustrated example embodiment allows the microprocessor 58 to direct the ASIC 60 to a particular location within a predefined sequence of states for controlling power to a fuel injector. In this example, the microprocessor 58 utilizes an index pulse prior to the initiation of an injection cycle to direct the ASIC 60 to a location within a predefined sequence as described or defined in the index register 76 represented in FIG. 2. In this example, the microprocessor 58 utilizes a length or duration of an index pulse as an indication of which index or location is desired. For example, the index register 76 in FIG. 2 includes a one microsecond index pulse directing the ASIC 60 to begin with the state assigned to profile slot 11, which is shown at 220. As shown in the profile register 78 of FIG. 2, state 1 is assigned to slot 11 at 222. When the microprocessor 58 provides a one microsecond index pulse to the ASIC 60, that directs the ASIC 60 to slot 11 according to the index register 76 and the ASIC 60 implements state 1 according to the profile register 78.

A two microsecond index pulse directs the ASIC 60 to the profile or sequence slot 14 to which state 4 is assigned according to the profile register 78 as shown at 226.

Additional indices and respective slot assignments can be used. The illustrated example includes up to eight index pulses each having a time duration in microseconds corresponding to the index number. The shortest index pulse in the illustrated example is one microsecond long while the longest index pulse is eight microseconds long.

The control signal 200 in FIG. 6 includes index pulses directing the ASIC 60 to a particular slot in the profile index 78 (FIG. 2). A first index pulse 230 has a one microsecond duration in this example. Using the example database information from the memory as illustrated in FIG. 2, a one microsecond index pulse directs the ASIC 60 to slot 11 of the profile index 78, which is assigned to state 1 so that the ASIC 60 begins the injector control shown in FIG. 6 by implementing state 1.

As shown in FIG. 6, the initiation of the current waveform for the injection cycle does not begin immediately after the index pulse 230. Instead, there is a built-in latency or programmed delay from the rising edge 232 of the control signal 200 to allow the ASIC 60 to distinguish between an index pulse and a command for the beginning of an injection cycle. In this example, a 10 microsecond delay shown at 234 passes between the rising edge 232 of the control signal 200 and the initiation of the injection cycle. A 10 microsecond delay is longer in duration than the longest of the index pulses provided in the example embodiment. The 10 microsecond latency or delay shown at 234 ensures that the ASIC 60 is able to recognize any of the potential index pulses to be appropriately directed to a corresponding location in a predefined sequence.

There is a similar delay between the trailing edge 236 of the control signal 200 and the termination of the injection cycle. This delay is also 10 microseconds in this example. Another way of considering the relationship between the time of the injection cycle and the timing of the control signal 200 is that the control signal 200 is shifted in time relative to the timing of the injection cycle by the latency or delay. That accounts for the possibility of an indexing signal that has a duration that is less than the latency or delay time.

The example of FIG. 6 includes another index pulse 240, which has a duration of two microseconds. Using the example information in FIG. 2, an index pulse of two microseconds directs the ASIC to slot number 14 as shown at 224 in the index register 76. Using the profile register 78, slot 14 is assigned to state 4. Accordingly, after a delay of 10 microseconds from the leading edge 242 of the control signal 200, the ASIC 60 initiates the corresponding injection cycle by implementing state 4. In this example, state 4 has the example state definitions from FIG. 4 and the sequence defined at 78 causes the ASIC 60 to control the driver 62 to provide power to the injector 52 including a current having the current waveform profile shown at 244 in FIG. 6.

As can be appreciated by comparing the waveform in FIG. 5 and the waveform of the injection cycle on the right side of FIG. 6, the current waveform 244 represents a subset of the states implemented to realize the current waveform 130 of FIG. 5.

The index pulse and interrupt pulse control features allow the microprocessor 58 to adjust operation of the ASIC 60 to accommodate differing needs or conditions for fuel injection. Additionally, the other test parameters related to the rate of change in current over time allow the ASIC 60 to control the current supplied to the fuel injector 52 in response to conditions that are detectible by the ASIC 60.

With embodiments of this invention, the processing load imposed on the microprocessor 58, the ASIC 60, or both, can be reduced while still providing enhanced and more versatile control over fuel injector operation. Embodiments of this invention allow for the microprocessor 58 to change the sequence of states based on engine synchronous position or other conditions because the microprocessor 58 can determine to change the waveform of current delivered to a fuel injector without providing a new parametric set to the ASIC 60 for redefining the waveform. The control technique of the disclosed example therefore reduces communication traffic between the microprocessor 58 and the ASIC 60 and reduces the processing load on the microprocessor 58.

Those skilled in the art who have the benefit of this description will realize that selected features described above may be utilized independent of others to realize other embodiments that include only some of the features or only some of the test parameters mentioned above and shown in the drawings. Some example embodiments only include test parameters pertaining to the control signal features provided by the microprocessor 58 such as the interrupt pulse 202 shown in FIG. 6, which indicates that the test parameter ConSelPulseLo is met. Other embodiments only include test parameters pertaining to conditions that are detectable by the ASIC 60 independent of input from the microprocessor 58, such as those related to the rate of change in current over time. Still other embodiments include a combination of all of the test parameters like the illustrated example embodiment of this description.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A fuel injector control system, comprising:

a driver that is configured to supply electrical power to a fuel injector;

and a controller configured to control the driver by implementing a predetermined sequence of a plurality of predefined states for an injection cycle, the plurality of predefined states each include parameters for supplying electrical power to a fuel injector, and select one of the states to implement as a next one of the states in the sequence based on a characteristic of an activation signal and information indicative of the state corresponding to the characteristic of the activation signal.

2. The fuel injector control system of claim 1, wherein the characteristic comprises a signal interrupt;

the controller is configured to interrupt an active one of the states in response to the signal interrupt; and the controller is configured to alter control of the driver from the predetermined sequence for a remainder of the injection cycle in response to the signal interrupt.

3. The fuel injector control system of claim 2, wherein the controller is configured to cause the driver to reduce current supplied to a fuel injector during a remainder of the injection cycle compared an amount of current required by a portion of the predetermined sequence corresponding to the remainder of the predetermined injection cycle.

4. The fuel injector control system of claim 2, wherein
the activation signal has a first value indicating that the sequence of states should be implemented to provide power to a fuel injector;
the characteristic comprises a second, different value of the activation signal; and
the characteristic comprises a duration of time when the activation signal has the second, different value.

5. The fuel injector control system of claim 4, wherein
the first value corresponds to a logical high; and
the second value corresponds to a logical low.

6. The fuel injector control system of claim 2, wherein the controller changes to a different sequence of the states from a remainder of the predetermined sequence in response to detecting the second value during the injection cycle.

7. The fuel injector control system of claim 1, wherein the characteristic defines an index signal as an indicator of the one of the states to select as an initial state of the predetermined sequence at a beginning of the injection cycle.

8. The fuel injector control system of claim 7, wherein
there are a plurality of index signals that each indicate a corresponding initial state; and
the characteristic of each index signal is different than the characteristic of the other index signals.

9. The fuel injector control system of claim 7, wherein the characteristic comprises an index signal duration.

10. The fuel injector control system of claim 9, wherein
the controller is configured to determine the initial one of the states based on the duration of a recognized index signal; and
the controller is configured to recognize an injection cycle start command based on a duration of the activation signal that exceeds a longest one of the index signal durations.

11. The fuel injector control system of claim 10, wherein
the controller is configured to control the driver to initiate a fuel injection cycle after a delay from a beginning of the activation signal; and
the delay is longer than the longest one of the index signal durations.

12. A method of controlling a fuel injector based on a plurality of predefined states that each include parameters for supplying electrical power to a fuel injector, the method comprising:
controlling power supplied to a fuel injector according to a predetermined sequence of the states for an injection cycle, and
selecting one of the states to implement as a next one of the states in the sequence based on a characteristic of an activation signal and information indicative of the state corresponding to the characteristic of the activation signal.

13. The method of claim 12, wherein the characteristic comprises a signal interrupt and the method comprises
interrupting an active one of the states in response to the signal interrupt; and
altering control of the driver from the predetermined sequence for a remainder of the injection cycle in response to the signal interrupt.

14. The method of claim 13, wherein
the activation signal has a first value indicating that the sequence of states should be implemented to provide power to a fuel injector;
the characteristic comprises a second, different value of the activation signal; and
the characteristic comprises a duration of time when the activation signal has the second, different value.

15. The method of claim 14, wherein
the first value corresponds to a logical high; and
the second value corresponds to a logical low.

16. The method of claim 13, comprising changing to a different sequence of the states from a remainder of the predetermined sequence in response to detecting the second value during the injection cycle.

17. The method of claim 12, wherein the characteristic defines an index signal as an indicator of the one of the states to select as an initial state of the predetermined sequence at a beginning of the injection cycle.

18. The method of claim 17, wherein
there are a plurality of index signals that each indicate a corresponding initial state; and
the characteristic of each index signal is different than the characteristic of the other index signals.

19. The method of claim 17, wherein the characteristic comprises an index signal duration and the method comprises
determining the initial one of the states based on the duration of a recognized index signal; and
recognizing an injection cycle start command based on a duration of the activation signal that exceeds a longest one of the index signal durations.

20. The method of claim 19, comprising initiating a fuel injection cycle after a delay from a beginning of the activation signal, wherein the delay is longer than the longest one of the index signal durations.

* * * * *